US007253677B1

(12) United States Patent
Kuramochi

(10) Patent No.: US 7,253,677 B1
(45) Date of Patent: Aug. 7, 2007

(54) BIAS CIRCUIT FOR COMPENSATING FLUCTUATION OF SUPPLY VOLTAGE

(75) Inventor: Takashi Kuramochi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 11/430,086

(22) Filed: May 9, 2006

(51) Int. Cl.
*G05F 1/10* (2006.01)

(52) U.S. Cl. ..... 327/538; 327/535

(58) Field of Classification Search ..... 327/513, 327/542, 538, 535; 323/315, 316
See application file for complete search history.

(56) References Cited

U.S. PATENT DOCUMENTS 6,124,753 A * 9/2000 Pease ..... 327/538
6,259,307 B1 7/2001 Aram
6,580,261 B1 6/2003 Dow

FOREIGN PATENT DOCUMENTS

JP 10-200339 7/1998

* cited by examiner

*Primary Examiner*—Shawn Riley
(74) *Attorney, Agent, or Firm*—Nixon Peabody LLP; Donald R. Studebaker

(57) ABSTRACT

A supply voltage bias circuit includes: an output circuit which comprises a first transistor having a terminal from which output voltage or output current is supplied, the output voltage and output current having values proportional to a supply voltage at a supply line; a second transistor forming a current mirror circuit together with the first transistor, the second transistor being connected to a first connection node; a third transistor connected to the first connection node; and a current source connected between the first connection node and the supply line. Drains of the second and third transistors or sources of the second and third transistors are commonly connected to the first connection node. The drains or sources of the second and third transistors which are not connected to the first connection node are grounded or earthed. The first connection node is connected to a gate of the third transistor and is functioning as an output terminal of the bias circuit.

6 Claims, 5 Drawing Sheets

Prior Art

BIAS CIRCUIT FOR COMPENSATING FLUCTUATION OF SUPPLY VOLTAGE

TECHNICAL FIELD OF THE INVENTION

The present invention generally relates to a bias circuit for compensating fluctuation of supply voltage. Especially, the present invention relates to a bias circuit for compensating current value fluctuating or changing due to fluctuation of supply voltage. The present invention can be used for an amplifier and other RF circuits.

BACKGROUND OF THE INVENTION

In an electronic circuit, electrical characteristics, including an output current value and amplification factor, may be changed due to fluctuation of supply voltage and temperature change. There have been many conventional methods for compensating fluctuation of electrical characteristics invented. However, the conventional methods are not good enough, and a higher performance of bias circuit has been required.

OBJECTS OF THE INVENTION

Accordingly, an object of the present invention is to provide a bias circuit for compensating fluctuation of a supply voltage efficiently.

Additional objects, advantages and novel features of the present invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

According to the present invention, a supply voltage bias circuit includes: an output circuit which comprises a first transistor having a terminal from which output voltage or output current is supplied, the output voltage and output current having values proportional to a supply voltage at a supply line; a second transistor forming a current mirror circuit together with the first transistor, the second transistor being connected to a first connection node; a third transistor connected to the first connection node; and a current source connected between the first connection node and the supply line. Drains of the second and third transistors or sources of the second and third transistors are commonly connected to the first connection node. The drains or sources of the second and third transistors which are not connected to the first connection node are grounded or earthed. The first connection node is connected to a gate of the third transistor and is functioning as an output terminal of the bias circuit.

The current source may be an absolute-temperature proportional power source or a band-gap power source.

The output circuit may include a reference voltage generation circuit, which generate a reference voltage proportional to the supply voltage; a supply voltage output terminal outputting the supply voltage; an operational amplifier having an inversion input terminal and a non-inversion input terminal, the non-inversion input terminal being connected to the supply voltage output terminal; a resistive element comprising a first terminal connected to the inversion input terminal of the operational amplifier and a second terminal, which is grounded or earthed; and a fifth transistor forming a current mirror circuit together with the fourth transistor. A source or drain of the fifth transistor is connected to a source of drain of the first transistor.

The resistive element may have a resistance-temperature coefficient which changes by temperature.

The supply voltage bias circuit may further include an output terminal that is connected to an amplifier circuit. The amplifier circuit may include a transistor of which a source is grounded or earthed.

DETAILED DISCLOSURE OF THE INVENTION

In the following detailed description of the preferred embodiments, reference is made to the accompanying drawings which form a part hereof, and in which is shown by way of illustration specific preferred embodiments in which the inventions may be practiced. These preferred embodiments are described in sufficient detail to enable those skilled in the art to practice the invention, and it is to be understood that other preferred embodiments may be utilized and that logical, mechanical and electrical changes may be made without departing from the spirit and scope of the present inventions. The following detailed description is, therefore, not to be taken in a limiting sense, and scope of the present inventions is defined only by the appended claims.

Figure 1:
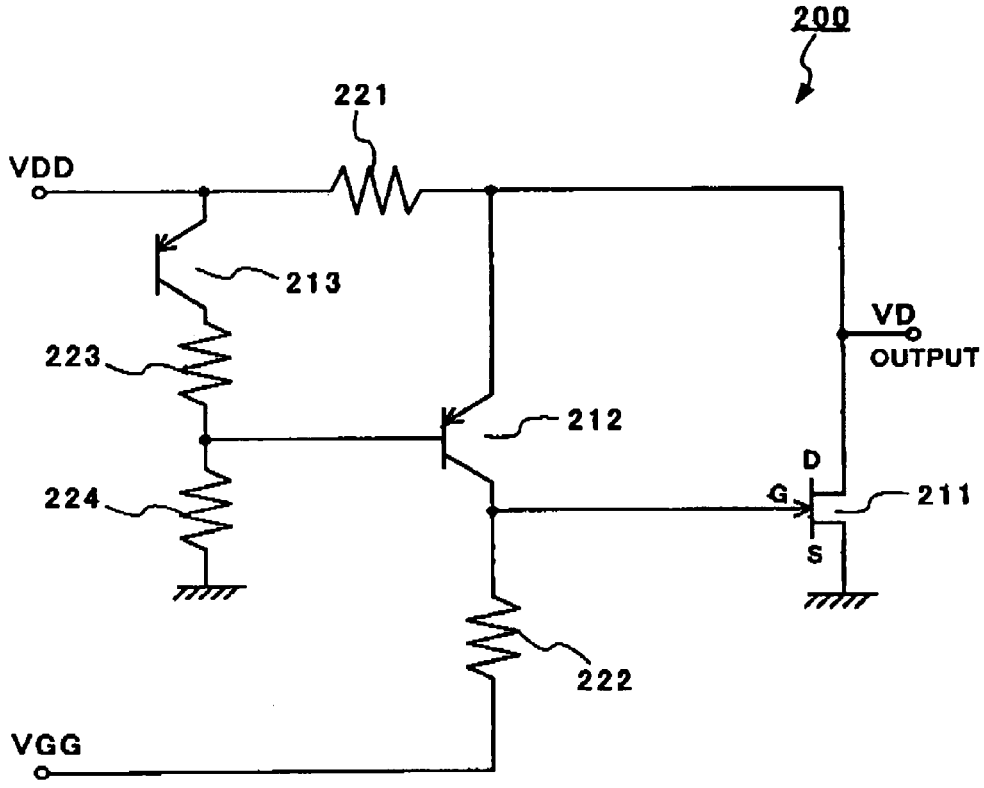
FIG. 1 is a circuit diagram illustrating a conventional bias circuit.

FIG. 1 shows a conventional bias circuit for temperature compensation. A bias circuit 200 compensates fluctuation of drain current of a transistor 211, which may occur due to temperature change. The transistor 211 is a field effect transistor of which a source is grounded. The bias circuit 200 includes resistive elements 221, 222, 223 and 224. A first PNP transistor 212 is connected between a gate and a drain of the transistor 211. A drain of the transistor 211 is connected to a positive power source VDD through the resistive element 221.

A gate of the transistor 211 is connected to a negative power source VGG through the resistive element 222. A second PNP transistor 213 is connected between a base and a corrector of the first PNP transistor 212 through the resistive elements 223 and 221. The first PNP transistor 212 and the second PNP transistor 213 are arranged closely in position on the same substrate. The first PNP transistor 212 and the second PNP transistor 213 may have the same electrical characteristics. A gate of the first PNP transistor 212 is grounded through the resistive element 224. A base and an emitter of the second PNP transistor 213 are connected directly to have the same electrical potential (voltage) as each other.

When the temperature of the bias circuit 200 changes, fluctuation of a base-emitter voltage of the first PNP transistor 212 would be compensated by the second PNP transistor 213. The first PNP transistor and the second PNP transistor 213 prevent fluctuation of circuit parameters. Drain-source voltage and drain current of the field effect transistor 211 is automatically stabilized by the first PNP transistor 212. Also, temperature fluctuation of drain current of the field effect transistor 211 may be compensated.

Figure 2:
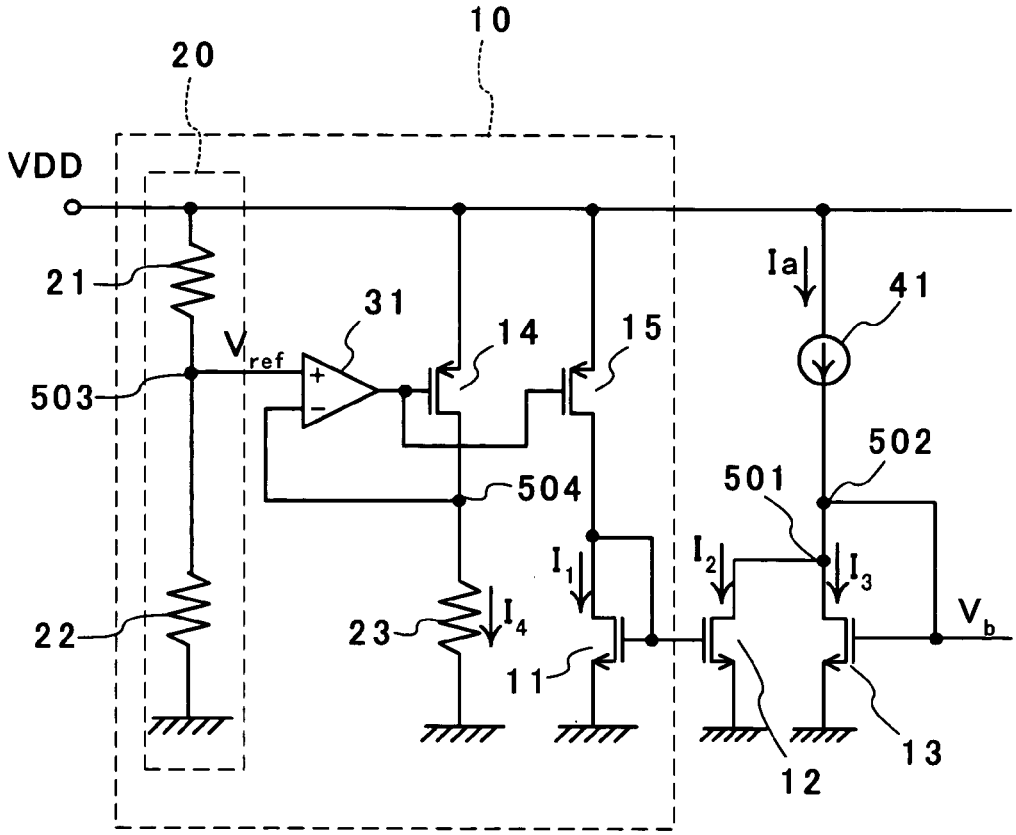
FIG. 2 is a circuit diagram illustrating a supply voltage bias circuit according to the present invention.

Now referring to FIG. 2, which illustrates a supply voltage bias circuit according to a preferred embodiment of the present invention, a supply voltage bias circuit includes an output circuit 10 for power source characteristics, a current source 41 and transistors 12 and 13. The output circuit 10 is connected to a power supply line VDD. The output circuit 10 includes a reference voltage generation circuit 20, which generates a reference voltage $V_{ref}$ proportional to a supply voltage (VDD). The reference voltage generation circuit 20 is connected between the supply line VDD and the ground. The reference voltage generation circuit 20 includes a resistor 21 connected between the supply line VDD and a connection node 503, and a resistor 22 connected between the connection node 503 and the ground. The resistors 21 and 22 have resistance values of R1 and R2, respectively.

A reference voltage $V_{ref}$ is provided at the connection node 503. The reference voltage $V_{ref}$ is indicated by the following equation:

$$V_{ref}=R2/(R1+R2)\times VDD$$

As indicated by the above equation, the reference voltage $V_{ref}$ is proportional to the supply voltage VDD.

The connection node 503, which is an output terminal of the reference voltage generation circuit 20, is connected to a positive input terminal of an operational amplifier 31. A negative or inversion input terminal of the operational amplifier 31 is connected to a connection node 504. The output circuit 10 includes a resistor 23 The connection node 504 is connected to an end of the resistor 23, of which the other end is grounded. The output circuit 10 further includes a fourth transistor 14, of which source and drain are connected between the connection node 504 and the supply voltage line VDD. A gate of the fourth transistor 14 is connected to an output terminal of the operational amplifier 31.

The potential difference between the positive input terminal and the negative input terminal of the operational amplifier 31 is 0V. The electrical potential of the connection node 504 is corresponding or identical to the reference voltage $V_{ref}$. A resistance value of the resistor 23 is R3.

Electrical current $I_4$ flowing through the resistor 23 is indicated by the following equation:

$$I_4=V_{ref}/R3$$

The output circuit 10 also includes a first transistor 11 and a fifth transistor 15. The fifth transistor 15 forms a current mirror circuit together with the fourth transistor 14. The gate of the fourth transistor 14 and a gate of the fifth transistor 15 are connected to each other. A source or drain of the fifth transistor 15 is connected to a source or drain of the first transistor 11.

According to operation of the current mirror circuit formed by the fourth and fifth transistors 14 and 15, a current $I_1$ that is identical to the current $I_4$ flowing through the resistor 23 flows through the first transistor 11. The current $I_1$ is proportional to the supply voltage VDD as shown below:

$$I_4=I_1=V_{ref}/R3=R2/(R3/(R1;R2))\times VDD$$

The output circuit 10 outputs the current $I_1$ from a gate terminal of the first transistor 11. A second transistor 12 is provided to form a current mirror circuit together with the first transistor 11. According to operation of the current mirror circuit, formed by the first and second transistors 11 and 12, a current $I_2$ flowing through the second transistor becomes identical to the current $I_1$ flowing through the first transistor 11.

$$I_2=I_1$$

If the second transistor 12 is of an NMOS, a source of the second transistor 12 would be grounded. A third transistor 13 is provided in parallel to the second transistor 12. The third transistor 13 is also of a NMOS of which a source is grounded. Drains of the second and third transistors 12 and 13 are connected to each other at a connection node 501. A current source 41 is connected between the supply source VDD and the connection node 501.

A gate of the third transistor 13 is connected to a connection node 502, which has the same potential (voltage level) as the connection node 501. The gate of the third transistor 13 functions as an output terminal $V_b$ of the supply voltage bias circuit.

The second transistor 12 and the third transistor 13 may be PMOS transistors. In that case, sources of the second and third transistors 12 and 13 would be connected to the power source line VDD, while drains of the second and third transistors 12 and 13 would be grounded. The connection node 501 would be also grounded.

The current source 41 is preferably of an absolute-temperature proportional source or of a band-gap source.

According to the embodiment, current $I_a$ of the current source 41 is divided into $I_2$ and $I_3$, flowing through the second and third transistors 12 and 13, respectively. In other words, the current $I_a$ supplied from the current source 41 is identical to the summation of the current $I_2$ and $I_3$ as indicated follows:

$$I_a=I_2+I_3$$

A gate voltage of the second transistor 12 changes proportional to the supply voltage VDD. The current $I_2$ flowing through the second transistor 12 changes proportional to the supply voltage VDD. When the current $I_2$ flowing through the second transistor 12 increases, the current $I_3$ flowing through the third transistor 13 would decrease. On the other hand, when the current $I_2$ flowing through the second transistor 12 decreases, the current $I_3$ flowing through the third transistor 13 would increase. According to the embodiment, fluctuation of supply voltage VDD can be compensated. An output current $I_3$ outputted from the output terminal $V_b$ is indicated by the following equation:

$$I_3=I_a-I_2=I_a-R2/(R3(R1+R2))\times VDD$$

Figure 3:
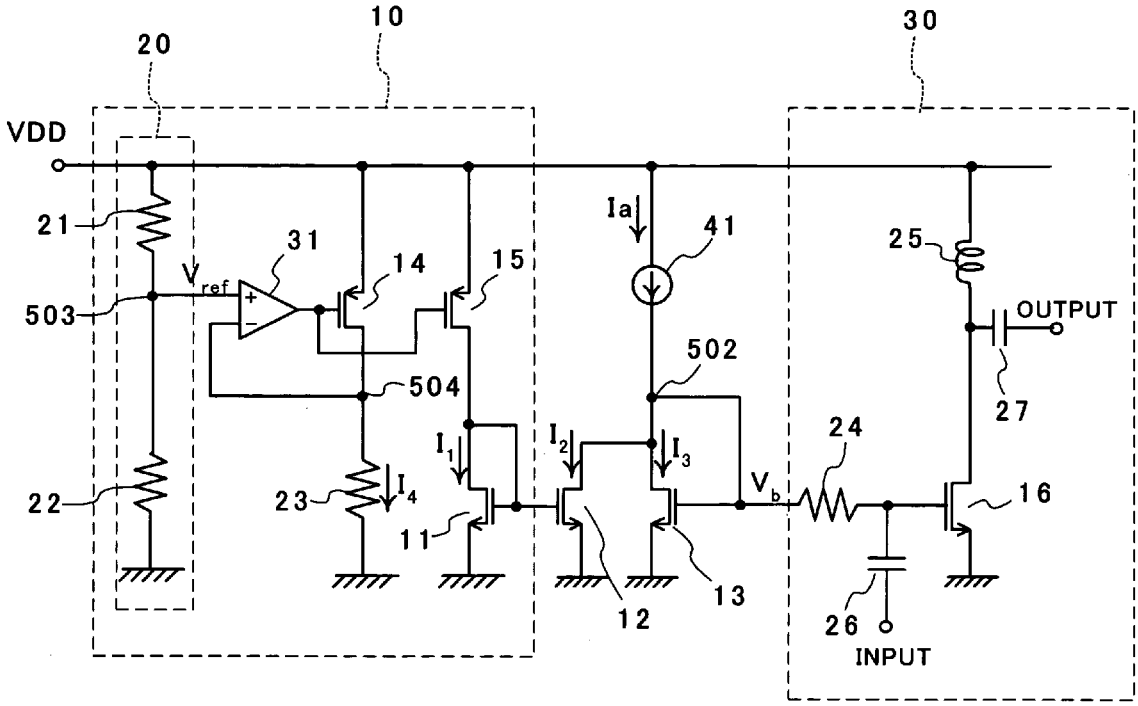
FIG. 3 is a circuit diagram illustrating the bias circuit, shown in FIG. 2, applied to an amplifier circuit.

FIG. 3 shows the supply voltage bias circuit, according to the present invention, applied to an amplification circuit. The supply voltage bias circuit is the same as shown in FIG. 2, and the same description will not be repeated for avoiding redundancy.

The output $V_b$ of the supply voltage bias circuit is supplied to an amplification circuit (amplifier) 30. The amplification circuit 30 includes a sixth transistor 16, of which a source is grounded. The amplification circuit 30 also includes an inductor 25 for high frequency. The inductor 25 may be used for functioning as a resistor, so that the amplification circuit 30 would be able to operate lineally. The output Vb of the supply voltage bias circuit is an input of the amplification circuit 30.

The amplification circuit 30 further includes a resistor 24 and a capacitor 26, which form a high-pass filter for removing a DC (Direct Current) component of an input signal. On the other hand, the inductor 25 and a capacitor 27 form a high-pass filter, which removes a DC component of an output signal.

The output current $I_3$ of the supply voltage bias circuit is used as a bias current of the amplification circuit 30. Electric current having an amount, which is a multiple of the current $I_3$, flows through a drain of the sixth transistor 16. When the supply voltage VDD increases, the current $I_3$ would decrease, and therefore; a gate bias voltage of the sixth transistor 16 would decrease as well. A source/drain voltage (potential difference) of the sixth transistor 16 would decrease, and a gain Gm of the sixth transistor 16 would decrease. As a result, fluctuation of gain of the amplification circuit 30 is prevented.

On the other hand, when the supply voltage VDD decreases, the current $I_3$ would increase, and therefore; a gate bias voltage of the sixth transistor 16 would increase as well. A source/drain voltage (potential difference) of the sixth transistor 16 would increase, and a gain Gm of the sixth transistor 16 would increase. As a result, fluctuation of gain of the amplification circuit 30 is prevented.

In FIG. 3, the resistor 23 can be replaced by an element having a resistance-temperature coefficient in that a resistant value changes in response to variation of temperature. The supply voltage bias circuit could prevent fluctuation of circuit parameters, which change in response to temperature variation. Since a resistive element has a positive temperature coefficient, a resistive value of the resistor 23 is increased when the temperature is increased. As a result, current flowing through the fourth transistor 14 is decreased, current $I_2$ flowing through the second transistor 12 is decreased, and current $I_3$ flowing through the third transistor 13 is increased. Therefore, a gate bias voltage of the sixth transistor 16 is increased.

In general, a gain Gm of a transistor is decreased when the temperature thereof is increased. According to the present invention, since a gate bias voltage of the sixth transistor 16 is increased when the temperature thereof is increased. A gain Gm of the sixth transistor 16 is prevented from being decreases. On the other hand, when the temperature thereof is decreased, a gate bias voltage of the sixth transistor 16 would be decreased.

As described above, according to the present invention, a gain of the amplification circuit 30 can be maintained at a stable value.

Figure 4:
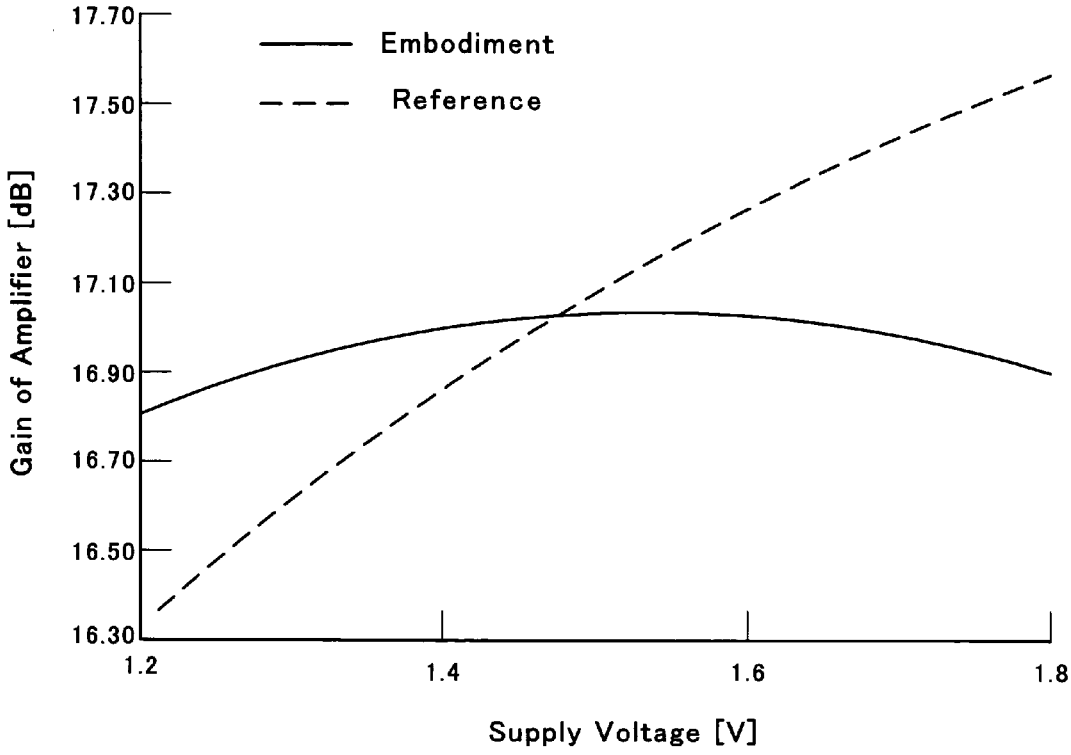
FIG. 4 is a graph showing performance of the present invention, in which variation of gain of amplifier responding to variation of supply voltage is shown.
Figure 5:
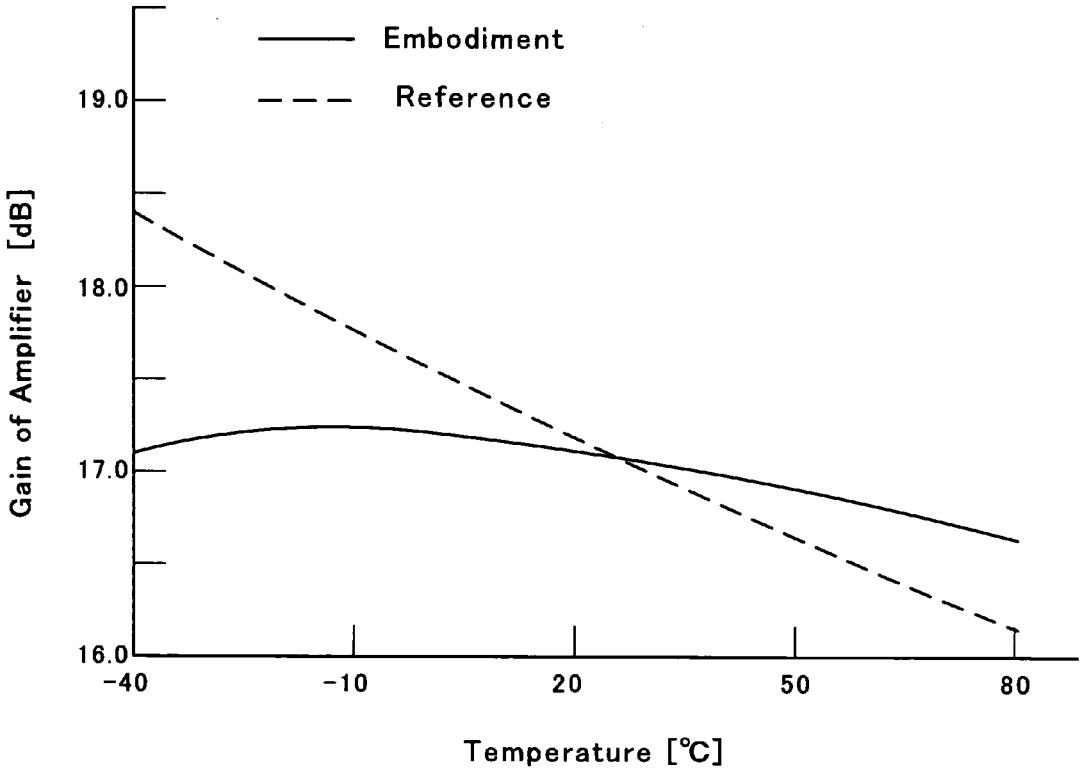
FIG. 5 is a graph showing performance of the present invention, in which variation of gain of amplifier responding to temperature variation is shown.

FIG. 4 shows performance of the present invention, in which variation of gain of the amplification circuit 30 responding to variation of supply voltage VDD is shown. FIG. 5 is a graph showing performance of the present invention, in which variation of gain of the amplification circuit 30 responding to temperature variation is shown.

According to the present invention, fluctuation of a supply voltage can be compensated efficiently.

In FIGS. 2 and 3, the resistor 23 may have a positive temperature coefficient, but may be replaced by a thermistor having a negative temperature coefficient. Another resistor Rx can be provided between the resistor 23 and the fourth transistor 14. In this case, a negative input terminal of the operational amplifier 31 would be connected between the additional resistor Rx and the resistor 23 to improve voltage accuracy.

Further, the current mirror circuit formed by the fourth and fifth transistors 14 and 15 can be duplicated to form a cascode type circuit to improve current accuracy.

What is claimed is:

1. A supply voltage bias circuit, comprising:

an output circuit which comprises a first transistor having a terminal from which output voltage or output current is supplied, the output voltage and output current having values proportional to a supply voltage at a supply line;

a second transistor forming a current mirror circuit together with the first transistor, the second transistor being connected to a first connection node;

a third transistor connected to the first connection node; and a current source connected between the first connection node and the supply line, wherein drains of the second and third transistors or sources of the second and third transistors are commonly connected to the first connection node, the drains or sources of the second and third transistors which are not connected to the first connection node are grounded or earthed, the first connection node is connected to a gate of the third transistor and is functioning as an output terminal of the bias circuit.

2. A supply voltage bias circuit according to claim 1, wherein the current source is an absolute-temperature-proportional power source or a band-gap power source.

3. A supply voltage bias circuit according to claim 1, wherein the output circuit comprises:

a reference voltage generation circuit, which generate a reference voltage proportional to the supply voltage;

a supply voltage output terminal outputting the supply voltage;

an operational amplifier having an inversion input terminal and a non-inversion input terminal, the non-inversion input terminal being connected to the supply voltage output terminal;

a resistive element comprising a first terminal connected to the inversion input terminal of the operational amplifier and a second terminal, which is grounded or earthed; and a fifth transistor forming a current mirror circuit together with the fourth transistor, wherein a source or drain of the fifth transistor is connected to a source of drain of the first transistor.

4. A supply voltage bias circuit according to claim 3, wherein the resistive element has a resistance-temperature coefficient which changes by temperature.

5. A supply voltage bias circuit according to claim 1, further comprising:

an output terminal that is connected to an amplifier circuit.

6. A supply voltage bias circuit according to claim 5, wherein the amplifier circuit comprises a transistor of which a source is grounded or earthed.

* * * * *